US005860905A

United States Patent [19]

Bruno

[11] Patent Number: 5,860,905

[45] Date of Patent: Jan. 19, 1999

[54] SYSTEM AND METHOD FOR MAKING PLASTIC FILM BAGS WITH HEADERS, OPEN MOUTHS AND SEALED BOTTOMS

[76] Inventor: Edward C. Bruno, 15336 E. Penwood Pl., Aurora, Colo. 80015

[21] Appl. No.: 730,049

[22] Filed: Oct. 15, 1996

[51] Int. Cl.[6] ..... B31B 23/80; B31B 27/60

[52] U.S. Cl. ..... 493/194; 493/195; 493/204; 493/236; 493/926

[58] Field of Search ..... 493/193–197, 493/199, 200, 207, 209, 223, 232, 234, 236, 237, 239, 388, 389, 343, 344, 359, 926, 204; 206/554

[56] References Cited

U.S. PATENT DOCUMENTS

| | | | |
|---|---|---|---|
| 4,181,069 | 1/1980 | Porter | 493/196 |
| 4,476,979 | 10/1984 | Reimann | 206/554 |
| 4,518,378 | 5/1985 | Schulz | 493/194 |
| 4,526,565 | 7/1985 | Hummel | 493/196 |
| 4,785,696 | 11/1988 | Martiny | 493/343 |
| 4,796,499 | 1/1989 | Achelpohl | 493/194 |
| 4,995,860 | 2/1991 | Wilfong | 493/195 |
| 5,009,740 | 4/1991 | Yanai | 493/194 |
| 5,045,042 | 9/1991 | Rutledge | 493/196 |
| 5,062,716 | 11/1991 | Conrad | 206/554 |
| 5,215,275 | 6/1993 | Gold | 493/194 |
| 5,244,450 | 9/1993 | Koehn | 493/195 |
| 5,282,778 | 2/1994 | Achelpohl | 493/194 |
| 5,469,969 | 11/1995 | Haung | 206/554 |
| 5,484,376 | 1/1996 | Prader | 493/194 |
| 5,562,580 | 10/1996 | Beasley | 493/194 |
| 5,590,784 | 1/1997 | Daniels | 206/554 |
| 5,630,779 | 5/1997 | Glod | 493/194 |

*Primary Examiner*—Joseph J. Hail, III
*Assistant Examiner*—Christopher W. Day

[57] ABSTRACT

A system for receiving tubular formed film comprising two facing walls and forming plastic bags having headers, open mouths and sealed bottoms into a block or stack of bags. The system includes an opener means for severing a spaced perforation on only one wall of the film to make a bag with an open mouth.

5 Claims, 3 Drawing Sheets

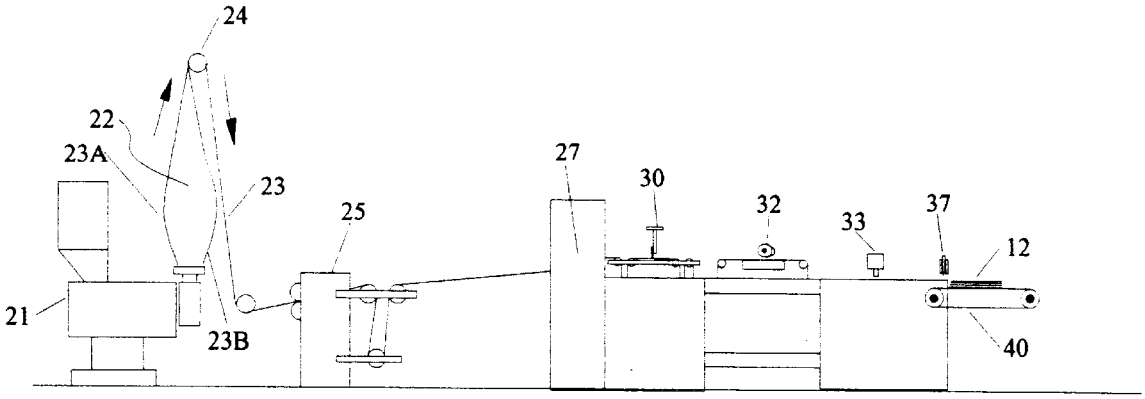
FIG. 3
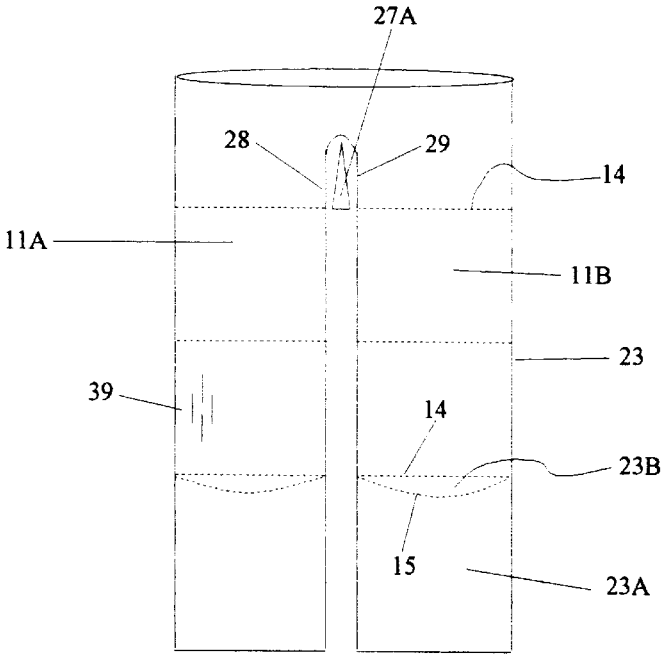
FIG. 4
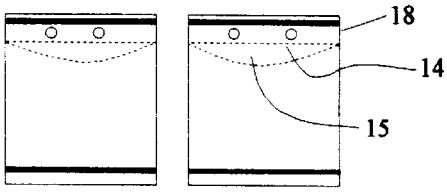

SYSTEM AND METHOD FOR MAKING PLASTIC FILM BAGS WITH HEADERS, OPEN MOUTHS AND SEALED BOTTOMS

BACKGROUND OF THE INVENTION

Plastic bags for receiving products such as produce are well known in the art. Large numbers of such bags are in wide use particular in areas such as the produce departments of grocery stores. Certain applications for plastic bags require bags wherein the mouth of the bag is quickly opened to efficiently insert the produce or product into the bag. Such cases include "deli" type use where a clerk must quickly insert the desired product into the bag and then move his or her attention to a subsequent task or to another customer.

SUMMARY OF THE INVENTION

A system for forming plastic bags having headers, a pre-opened mouth, and a sealed bottom such as for use in receiving produce. The system receives tubular plastic film pressed to have two facing walls as a continuous feed. The system includes perforation means for making spaced transverse perforations on the walls to form headers for the bags, and means for engaging the film and severing the perforations on only one of the two walls to effectively open the mouth of the bag. The bags are sealed at the header to form a block or stack of bags.

The foregoing features and advantages of the present invention will be apparent from the following more particular description of the invention. The accompanying drawings, listed hereinbelow, are useful in explaining the invention.

DRAWINGS

FIG. 3 shows an on-line system for making bags in accordance with the invention;

FIG. 4 depicts a process for making the inventive bag;

DESCRIPTION OF THE INVENTION

Figure 1:
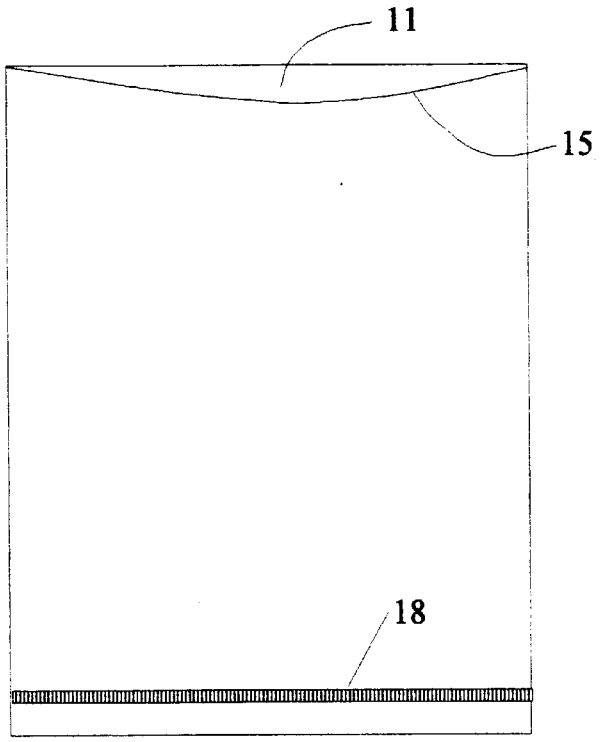
FIG. 1 is a front view of an inventive bag.

FIG. 1 shows the inventive bag 11 which is commonly formed of quite thin plastic; that is, in the 1 mm or less range of thickness. Normally such bags are used as a temporary enclosure for products or produce for transport from the store to the home.

Side seal plastic bags and bottom seal plastic bags are well known and are widely used. Typically, bottom seal bags are stronger and the equipment to make bottom seal bags runs much faster. The present invention is directed to a bottom seal bag that has a header and is pre-opened. This is in contrast to side sealed bags which have been made out of "J" fold material with the front wall shorter than the back wall and wherein the back wall is perforated and a hole punched and then wicketed. In the present invention, the wicketing step is eliminated.

Figure 2:
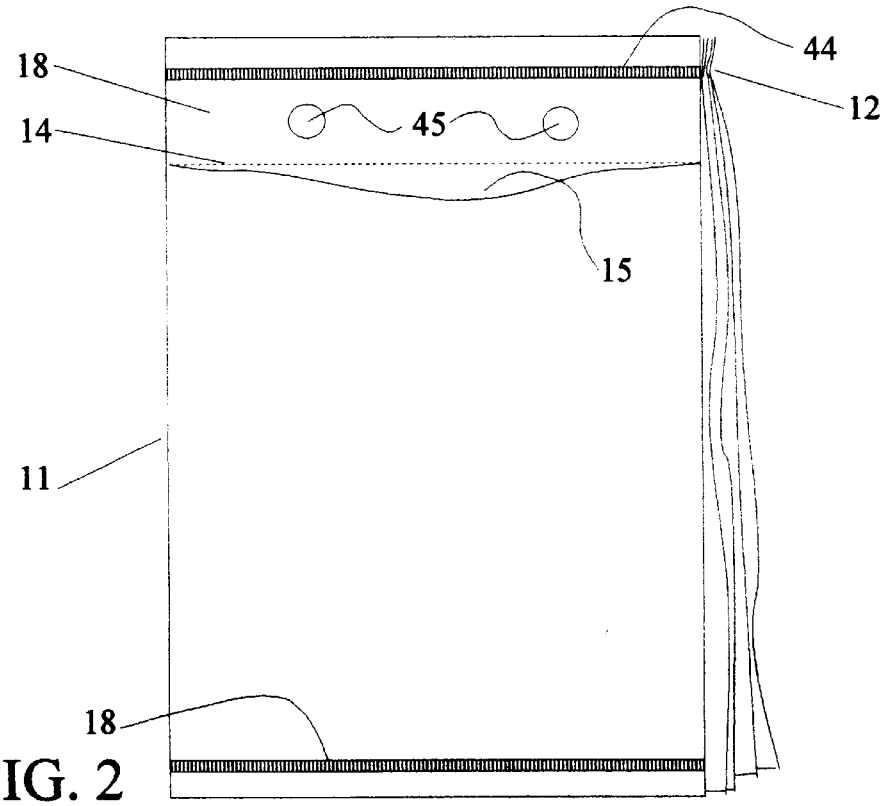
FIG. 2 is an isometric view of a block or stack of bags of FIG. 1.

It is a purpose of the present invention to provide bags 11 in a block or stack 12 of bags, see FIG. 2, wherein each individual bag 11 formed into the stack 12 has a non-sealed or open mouth 15 which can be easily opened by a user, and wherein an individual bag 11 can be easily separated from the block or stack 12 by a user.

As shown in FIG. 2, each bag 11 includes a header 18 useful for attaching the bags to one another to form stack 12 and to provide means for hanging the bag stack 12 on support hooks into which holes 45 are inserted.

Note of course, that the invention is not limited to a particular thickness of plastic, however the more prevalent usage of the invention is for the thinner gauge plastic bags.

Refer now to FIG. 3. In a preferred embodiment of the invention, the inventive bags are made in a unique on-line system 26 as will now be explained. FIG. 3 depicts an extruder 21 of any suitable well known type such as for example disclosed in U.S. Pat. No. Re. 29,208. However in the present invention no profiles are formed on the plastic as in Re. 29,208. In the present system 26, the plastic extruded as a tube 22 is cooled, and then pressed by suitable rollers 24 into a sheet 23 having two facing walls or sides 23A and 23B. Sheet 23 is then fed through drive rollers and tension devices 25 which adjust the feed and tension on the plastic sheet 23 for further processing in the bag making machinery.

Sheet 23 is thus fed directly from the extruder 21 through the rollers and tension device 25 to the bag-making system 26. Refer now also to FIG. 4 which depicts various steps in the bag making process. System 26 includes a slitter and sealer unit 27, of any suitable known type, which includes a slitter blade or unit 27A (FIG. 4) which slits or cuts the sheet 23 in half. This enables the forming of two bag blanks (not completed formed bags) 11A and 11B positioned adjacent one another. The slitter and sealer 27 also seals the cut edges 28 and 29 of the sheet 23 to thus form sealed edges for walls 23A and 23B of bags 11.

Referring again to FIG. 3, next, the sheet 23 is fed to a perforator device 30, of any suitable known type, which makes spaced transverse perforations 14 on the two sides 23A and 23B of the sheet 23. Perforator device 30 also includes reciprocating and spaced knives, of any suitable known type, which are selectively activated to cut longitudinal slits or vents 39 in the walls or sides 23A and/or 24B of the bags 11 to provide vented bags, useful for venting produce inserted in the bag.

Figure 5:
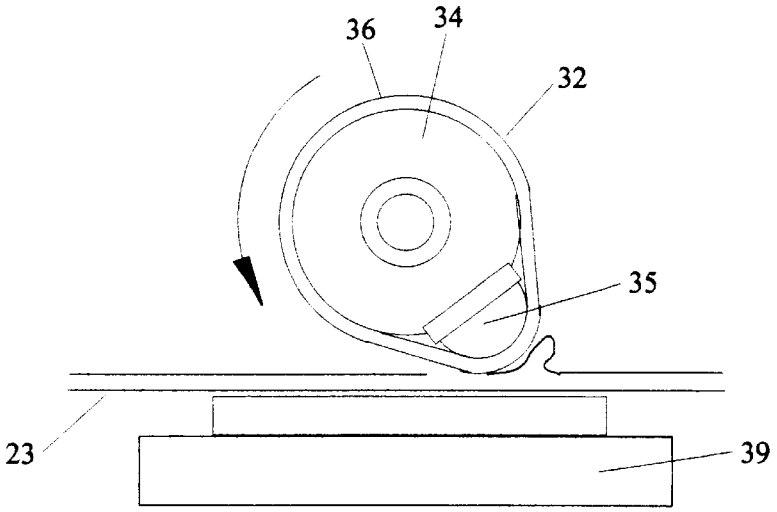
FIG. 5 shows, in relatively enlarged detail, the roller sub-system of FIG. 3 useful in opening the bags of FIG. 1; and, FIG. 6 shows a sub-system of FIG. 3, in relatively enlarged detail, useful for severing the bags depicted in FIG. 4 and for stacking the bags to form the stack of FIG. 2.

As the next step of the bag making operation, the slitted and perforated sheet 23 is fed into a bag mouth opening device or opener 32. FIG. 5 shows the opener 32 in more detail. Opener 32 comprises a rotating roller 34 which includes a protuberance 35 extending in an axial direction on the periphery of roller 34. Rubber belting 36 extends around the periphery of roller 34 and protuberance 35. The roller 34 is of an adjusted size and rotational speed such that a single revolution of roller corresponds to the distance from the perforation 14 of one bag 11 to the perforation 14 of the succeeding bag. As the roller 34 rotates, the protuberance 35 engages the wall 23A of sheet 23 at a point adjacent the perforation 14 with sufficient engaging force to pull on the one wall 23A of the bag 11 to tear the perforation 14 of that one wall 23A to thereby separate wall 23A at the perforation 14 and thus open the mouth 15 of the bag 11; the opened mouth 15 is depicted in FIG. 4.

Opener 32 includes and adjustable plate and anvil 39 to enable proper adjustment of moving sheet 23 relative to the protuberance 35 on roller 34 to assure the proper tension (tearing force) is provided by roller 34 and protuberance 35 to sheet wall 23A, only.

Figure 6:
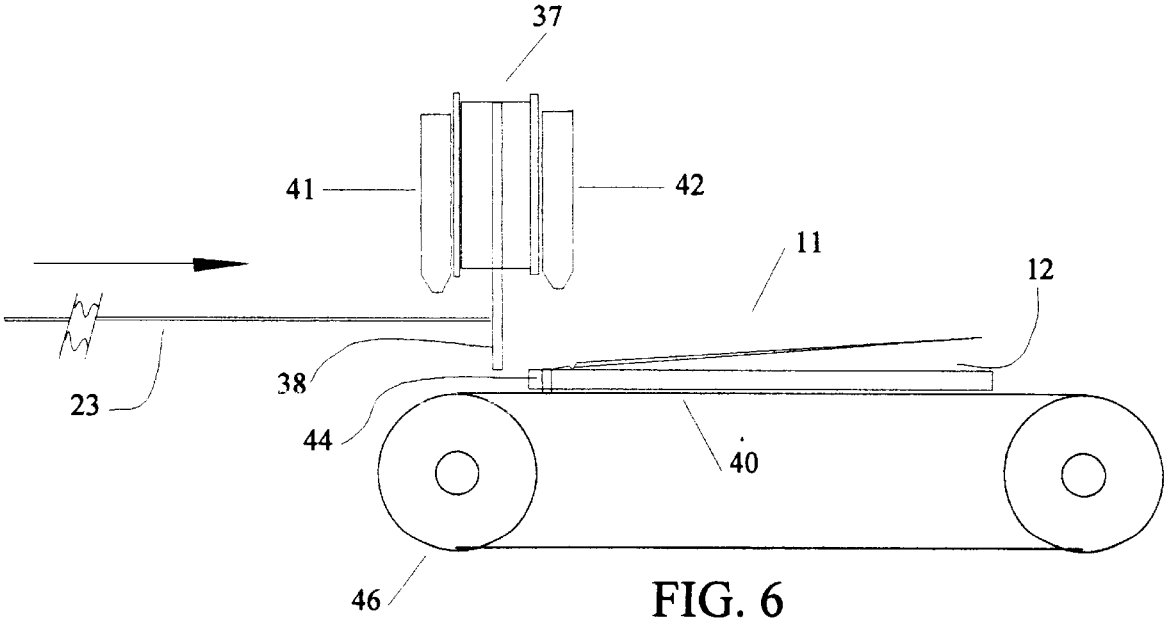

In the next step of the process, as shown in FIG. 3, the sheet 23 is fed to a seal and block device 37 which comprises a flying knife unit 38, straddled by two sealing heads 41 and 42, and a stacking and delivery module 43, all of suitable well know types. Refer now also to FIG. 6. Sealing head 41 seals the sheet 23 to form the bottom 18 of the bag 11, see also FIG. 2. Flying knife 38 next slices sheet 23. Note that two bags 11 are being made at the same time, see also FIG. 4. Note also, that for purposes of clarity in the drawing, the bottom backing or support for the sealing heads and the flying knife are not shown, but can be of any suitable known type.

Each pair of severed bags 11 drops or lands on a conveyor belt 40 having a roller 46 positioned beneath sealing head 42. Conveyor belt 40 thus provides a platform for receiving the bags 11 as a stack 12. Sealing head 42 seals the header 18 of each bag 11, as at 44, and also seals each newly made bag 11 to the bags 11 previously on stack 12. The header 18 is thus created by block sealing approximately one inch above the perforation 14. The number of bags in a stack 12, is counted by suitable electronic counters, any suitable known type, not shown, which count the number of times the flying knife 38 is actuated. When the desired number of bags 11 are formed into a stack 12, conveyor belt 40 is actuated to move the stack 12 toward an unloading position.

Hanger holes 45, as shown in FIG. 2, can be formed on the headers 18 of bags 11 by a reciprocating punching unit 33, of any suitable known type, mounted preferably at a position ahead of the seal and block device 37.

The inventive system 26 thus provides a stack 12 of bags 11 which can be mounted on support hooks on a wall on or a counter support frame to be readily accessible to enable a user to conveniently grasp a bag 11 from the stack 12 for use. The bag 11 already has an open mouth 15, and hence the user can promptly insert the product or produce in the bag without wasting time in opening the bag. This feature is particularly useful such as for use at a busy delicatessen counter or any other similar type of retail operation.

The inventive bag is shown as being made on-line, directly from plastic material extruded by the extruder and it is convenient and effective. However, it will be appreciated that the inventive bags can be made off-line from plastic sheet material which has previously been extruded, and which material is subsequently fed to a bag making machine. Further, the inventive bags can be made on separate lines using single or multiple tubing; this will eliminate the slit seal operation.

While the invention has been particularly shown and described with reference to a preferred embodiment thereof, it will be understood by those skilled in the art, that various changes in form and detail can be made therein without departing from the spirit and scope of the invention.

I claim:

1. A system for forming plastic bags into stacks from film extruded in tubular form, a) said system receiving said film as a continuous feed of longitudinal flat film having facing walls, b) perforation means for forming a perforation transversely across said film to thereby form bag blanks having headers;

c) rotating opener means for engaging said film and severing the perforation of only one of said walls of said sheet thereby forming a bag blank with a header and an open mouth;

d) sealing and blocking means for cutting said tubular material transversely, said sealing and blocking means forming a bag with a header and a heat sealed bottom; and e) said sealing and blocking means including a heat sealing head for sealing a plurality of said bags to one another to form a stack of bags;

whereby bags with a header, an open mouth and a heat sealed bottom are formed as selected stacks.

2. A system as in claim 1 further including, a) means forming a selectively movable platform for receiving said bags; and b) said sealing and blocking means sealing said plurality of said bags to one another as a stack of bags on said platform;

whereby bags with a header, an open mouth and a heat sealed bottom are formed as selected stacks.

3. A system as in claim 1 wherein said header includes holes for mounting said header and said stack of bags such as on supporting hooks.

4. A system for making bags in-line from plastic film extruded as a tube from an extruder wherein said plastic film is pressed into a flat tubular form having facing walls; said system comprising in combination:

a) means for receiving said film directly from the extruder as a continuous feed;

b) slitter and sealer means for longitudinally cutting said sheet material, and heat sealing the edges formed by the cutting action to form a plurality of tubes; transversely across said sheet;

c) opener means for engaging said film and tearing the perforation of only one of said walls of said film to form a bag blank with an open mouth;

d) sealing and blocking means for cutting said tubular material transversely, said sealing and blocking means forming a bag with a header and a heat sealed bottom; and, e) said sealing and blocking means including a heat sealing head for sealing a plurality of said bags to one another to form a stack of bags;

whereby bags with a header, an open mouth and a heat sealed bottom are formed as selected stacks.

5. A system as in claim 4 further including, a) means forming a selectively movable platform for receiving said bags; and b) said sealing and blocking means sealing said plurality of said bags to one another as a stack of bags on said platform;

whereby bags with a header, an open mouth and a heat sealed bottom are formed as selected stacks.

* * * * *